US006573873B2

(12) United States Patent
Lier

(10) Patent No.: US 6,573,873 B2
(45) Date of Patent: Jun. 3, 2003

(54) STEPPED HORN WITH DIELECTRIC LOADING

(75) Inventor: Erik Lier, Newtown, PA (US)

(73) Assignee: Lockheed Martin Corporation, Bethesda, MD (US)

( * ) Notice: Subject to any disclaimer, the term of this patent is extended or adjusted under 35 U.S.C. 154(b) by 0 days.

(21) Appl. No.: 09/877,856

(22) Filed: Jun. 8, 2001

(65) Prior Publication Data

US 2002/0196194 A1 Dec. 26, 2002

(51) Int. Cl.[7] ..... H01Q 13/00
(52) U.S. Cl. ..... 343/781 R; 343/783; 343/786
(58) Field of Search ..... 343/781 R, 772, 343/783, 784, 786

(56) References Cited

U.S. PATENT DOCUMENTS

| | | | | |
|---|---|---|---|---|
| 2,472,201 A | * | 6/1949 | Eyges | 343/786 |
| 2,617,937 A | * | 11/1952 | Van Atta | 343/786 |
| 4,757,326 A | | 7/1988 | Profera, Jr. | 343/786 |

* cited by examiner

*Primary Examiner*—Michael C. Wimer
(74) *Attorney, Agent, or Firm*—Duane Morris LLP

(57) ABSTRACT

A horn for direct radiation or for use as a reflector feed is for operation at disparate frequencies. The horn has a conventionally $LSE_{1,0}$ distribution at the lower of the two frequencies, and both $LSE_{1,0}$ and $LSE_{3,0}$ modes, phased for improved gain, at the higher frequency. The $LSE_{3,0}$ mode is generated by an H-plane step, and the appropriate phasing, together with improved gain at the lower operating frequency, is achieved by the use of dielectric loading adjacent the E-plane walls of the phasing section of the horn.

14 Claims, 8 Drawing Sheets

STEPPED HORN WITH DIELECTRIC LOADING

FIELD OF THE INVENTION

This invention relates to stepped horn antennas, and particularly to stepped horn antennas usable at disparate frequencies.

BACKGROUND OF THE INVENTION

Spacecraft-based communication systems often operate at disparate frequencies, as for example at 3.7-to-4.2 (3.95) GHz for downlink transmission and 5.925-to-6.425 (6.2) GHz for uplink transmission. At the spacecraft, transmission takes place at the lower frequency, and reception at the higher frequency. Because of the long transmission path lengths in satellite-based operation, and the resultant losses, it is common to use high-gain antennas at the spacecraft. Reflector-type antennas are widely used for both transmission and reception in satellite communication, because a relatively large radiating aperture can be achieved with a simple and lightweight structure. These reflector-type antennas require a feed antenna, as known in the art. Feed antennas for use with reflectors are not different from antennas used for other purposes, but their aperture distributions are tailored to produce the desired aperture distribution over the face of the reflector.

The tailoring of the aperture distribution of a reflector-type antenna by adjusting the nature of the feed antenna often requires a feed structure including a plurality of horn antennas, each of which is itself tailored to produce a portion of the aperture distribution. These several horn antennas add unwanted weight to the antenna portion of the spacecraft. As known to those involved in spacecraft, the cost of boosting or launching a mass to orbit is very great, and the on-station value of an operating communication satellite is large. Every measure is normally exerted to reduce the weight of all structures of a spacecraft, so that additional expendable propellant can be on-loaded, which allows more on-station time for the spacecraft. For this purpose, the number of reflector feed horns, and the size of each feed horn, should be kept to a minimum, commensurate with achieving appropriate radiation efficiency as measured by spillover of feed energy beyond the edges of the reflector(s).

In an antenna which uses a reflector and a plurality of feed horns to produce multiple overlapping beams on the Earth's surface, the spacing or overlapping of the beams (the angular separation of the beams) depends, at least in part, on the spacing between feed horns. Close beam spacing, in turn, requires close spacing of the feed horns, to the point at which the horns may actually touch, at which point closer spacing is not possible. In order to achieve closer angular beam spacing, the horns themselves must be small, so that their phase centers may be placed closer together. While horn apertures can always be made smaller, small size is generally correlated with low gain and a large beamwidth. However, the large beamwidth tends to create "spillover" losses, in which the feed-horn energy is not intercepted by the reflector.

In FIGS. 1*a* and 1*b*, a horn antenna 10 includes a metallic or conductive horn portion 12 defining an upper plate or wall 14*u* and a lower or bottom plate or wall 14*b*. In the embodiment of FIGS. 1*a* and 1*b*, the plates 14*a* and 14*b* extend parallel to each other, separated in a radiating-end or phasing region 16 by a left vertical plate or wall 18*l* and right vertical plate or wall 18*r*, and separated in a feed-end region 20 by a left vertical plate or wall 22*l* and a right vertical plate or wall 22*r*. The walls 14*u*, 14*b*, 18*l* and 18*r* together define a rectangular radiating aperture 26, and the walls 14*u*, 14*b*, 22*l*, and 22*r* together define a rectangular waveguide feed aperture. The direction of the electric field of the horn antenna 10 in normal operation is illustrated by arrow e, having terminations or ends at upper plate 14*u* and at lower plate 14*b*.

Those skilled in the arts of antennas know that the term "feed" and "radiating" are used in respect of antennas for historic reasons rather than as accurate descriptors, since the antenna is a transducer between guided energy and unguided or radiated energy, and the transduction operates in both directions of propagation. Thus, in a transmitting mode of operation, energy to be transmitted may be applied to the feed port, and is ideally all radiated from the radiating aperture, whereas in a receiving mode of operation, unguided energy is intercepted by the "radiating" aperture and is transduced to the "feed" port.

As illustrated in FIGS. 1*a* and 1*b*, upper wall 14*u* and lower wall 14*b* extend from feed aperture 24 to radiating aperture 26 without a step, whereas a step in dimension exists at a plane 28 lying between radiating-end or phasing portion 16 and feed-end portion 20. A pair of vertically disposed electrically conductive walls 24*l* and 24*r* are disposed coincident with plane 28, and are in conductive contact with the ends of the vertical walls. More particularly, a vertical wall 24*l* is connected to that portion of wall 18*l* remote from radiating aperture 26 and to that portion of vertical wall 22*l* remote from feed aperture 24. Similarly, a vertical wall 24*r* is connected to that portion of wall 18*r* remote from radiating aperture 26 and to that portion of vertical wall 22*r* remote from feed aperture 24.

The specification of the electric field direction identifies the various conductive walls of metallic horn 12 as being either in the Electric (E) plane or in the magnetic (H) plane. In particular, those electrically conductive plates on which the electric field lines terminate (when they are straight) are the E-plane walls, and correspond to walls or plates 14*u* and 14*b*. Those electrically conductive walls which are parallel to straight electric field lines are designated as H plane walls. Thus, walls 18*l*, 22*l*, and 24*l*, and walls 18*r*, 22*r*, and 24*r*, are all H-plane walls.

Stepped horns are known in the art, and are described, for example, in U.S. Pat. No. 4,757,326, issued Jul. 12, 1988 in the name of Profera, Jr. As described therein, a step transition in the H-plane dimensions of the horn set up $TE_{3,0}$ waveguide mode (equivalent to the $LSE_{3,0}$ mode) which interacts with the principal $TE_{1,0}$ mode (equivalent to the $LSE_{1,0}$ mode) to linearize the electric field amplitude distribution in the radiating aperture, for thereby increasing the effective aperture in the H plane. The $TE_{3,0}$ mode must be in-phase with the $TE_{1,0}$ mode near the H-plane walls of the horn in order to linearize the distribution, and if it should be out-of-phase, the amplitude distribution would be such as to reduce the effective aperture of the horn. The axial length of the phasing portion 16 of the antenna 12 is selected to provide the proper phasing of the $TE_{3,0}$ mode relative to the $TE_{1,0}$ at the radiating aperture 26.

Improved spacecraft antennas are desired.

SUMMARY OF THE INVENTION

A horn antenna according to an aspect of the invention includes an electrically conductive first waveguide portion defining a rectangular waveguide feed aperture and a second rectangular aperture which is larger than the feed aperture, at least in the H plane. The horn includes an electrically conductive rectangular second waveguide portion defining a radiating aperture and a second aperture. The second aperture of the second waveguide portion is larger than the second aperture of the first waveguide portion in the H plane, and the second aperture of the second waveguide portion is identical in dimension to the second aperture of the first waveguide portion in the E plane. The second apertures of the first and second waveguide portions are juxtaposed with corresponding polarizations, thereby defining an H-plane step in dimension, but not an E-plane step. The horn further includes electrically conductive means or walls coupling the walls of the first and second waveguide portions at the H-plane step, to thereby define continuous H-plane walls extending from the feed to the radiating apertures. The horn also includes first and second dielectric slabs, each of which dielectric slabs lies against or is juxtaposed to the E-plane walls of the second waveguide portion, and extend from near the step to near the radiating aperture.

In a particular embodiment of the horn, at least one of the first and second portions is tapered in the E plane, and preferably both portions are tapered in the E plane. The second portion of the horn may be square in cross-section. In yet another embodiment, each of the dielectric slabs is tapered in thickness, with the thickest portion lying nearest the radiating aperture.

In another avatar of the invention, a dielectric loaded stepped horn such as that described above is used as at least a portion of a feed of a reflector-type antenna.

In yet a further manifestation, the horn may include one or more further electrically conductive walls or vanes, lying roughly parallel with the E-plane walls, and spaced away from the E-plane walls and from each other when there is more than one such further wall. The further wall or walls are physically close to the H-plane walls of the horn.

DESCRIPTION OF THE INVENTION

Figure 7A:
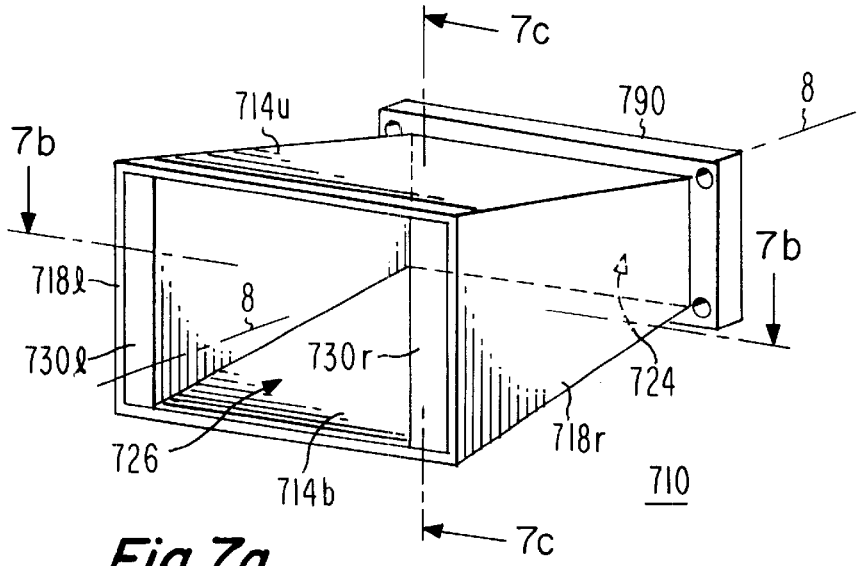
FIGS. 7*a*, 7*b* and 7*c* are views of a conventional tapered dielectric loaded horn antenna.
Figure 7B:
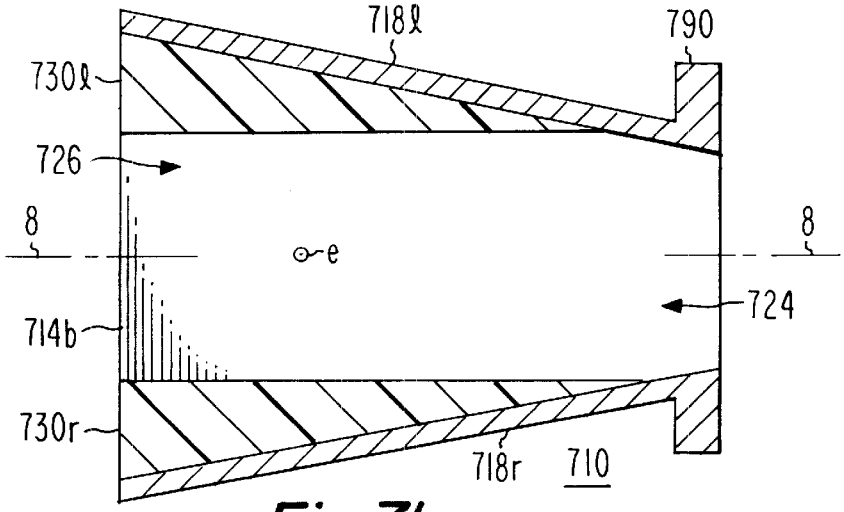
Figure 7C:
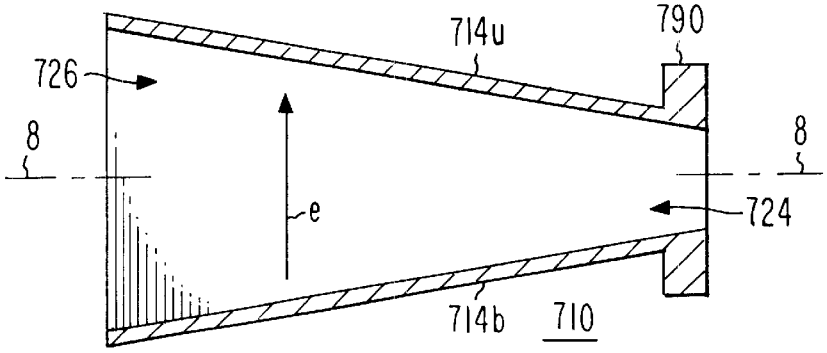

FIG. 7*a*, 7*b*, and 7*c* are views of a conventional tapered dielectric loaded horn antenna. In FIGS. 7*a*, 7*b*, and 7*c*, horn 710 includes a conductive upper wall 714*u* and a lower or bottom wall 714*b*, a left wall 718*l*, and a right wall 718*r*, defining a radiating aperture 726 and a feed aperture 724. A flange 790 is provided to allow fastening of a feed waveguide to the structure. Horn 710 is tapered in both directions or planes, so that walls 714*u* and 714*b* diverge with increasing distance from the feed aperture 724. Similarly, walls 718*l* and 718*r* diverge with increasing distance from feed aperture 724. Dielectric slabs 730*l* and 730*r* have planar surfaces which lie against the interior of walls 718*l* and 718*r*, respectively. As illustrated in FIG. 7*b*, the thickness of the dielectric slabs can vary with distance from the feed aperture. In the illustrated arrangement, the thickness of the dielectric slabs 730*l* and 730*r* is close to zero near the feed aperture 724, and thickest near the radiating aperture 726. The purpose of the dielectric slabs is to tend to concentrate the field distribution away from the axis 8 of the horn and toward the walls 718*l* and 718*r*, which in turn tends to linearize the aperture distribution, and increases the effective gain of the aperture, but at the cost of increased sidelobe levels. The taper of the dielectric slabs is intended to reduce the mismatch at the transition between the region including the dielectric and the feed region, by introducing the dielectric in a graded manner. In addition, the gradual transition tends to reduce or prevent the generation of undesired higher-order modes. A description of dielectric-loaded horns can be found in Tsandoulas, G. N., Fitzgerald, W. D., "Aperture Efficiency Enhancement in dielectrically loaded horns," published in the IEEE Transactions, 1972, AP-20, pp 69–74.

Figure 1A:
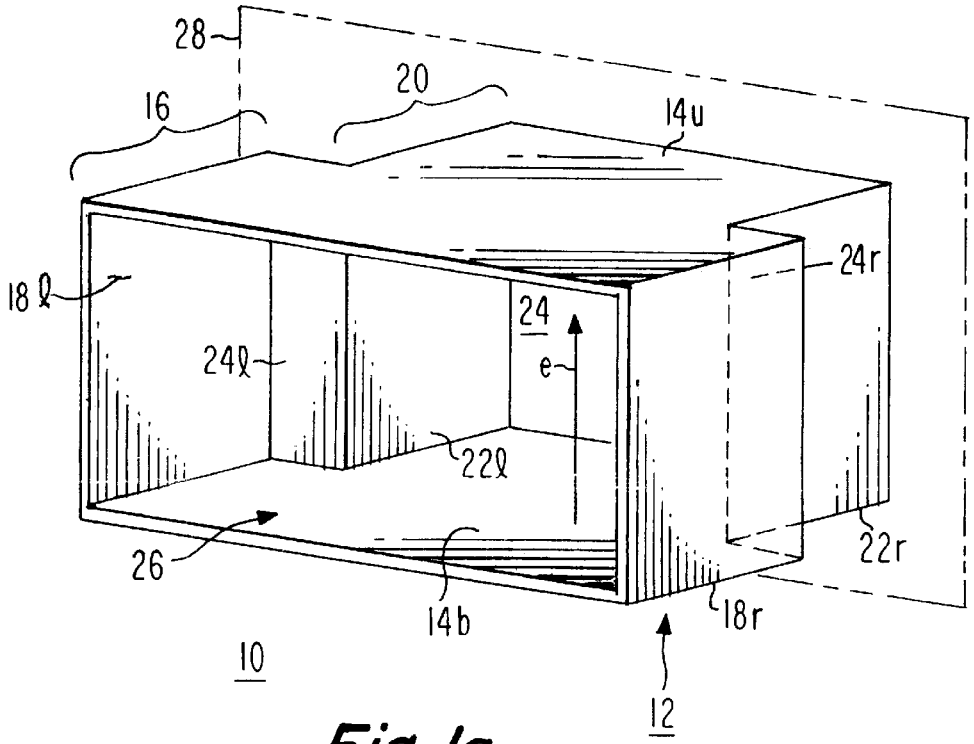
Fig. 1a PRIOR ART
FIGS. 1*a* and 1*b* are a simplified, exploded perspective or isometric views of a prior art horn antenna according, as seen from the radiating and feed sides, respectively.
Figure 1B:
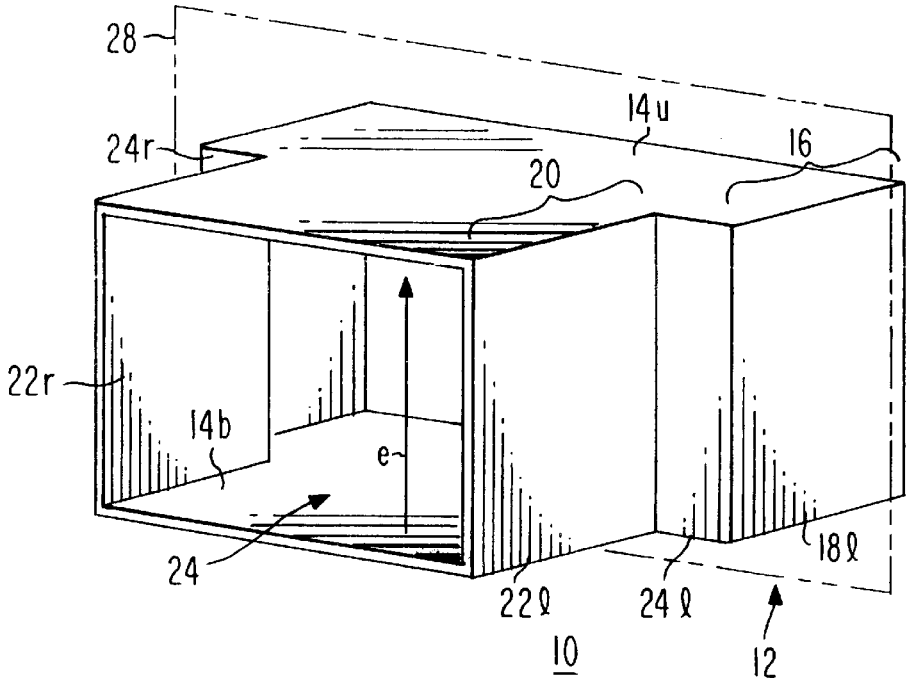
Fig. 1b PRIOR ART

A stepped horn antenna such as that described in conjunction with FIGS. 1*a* and 1*b* operates at frequencies such that its H-plane aperture dimension is greater than about 3/2 free-space wavelength ($\lambda$), or $d>3/2\ \lambda$. According to an aspect of the invention, only a single reflector is used for operation at both the downlink and uplink frequency bands, thereby reducing the need for two reflectors on the spacecraft for transmit and receive operation. According to another aspect of the invention, the single reflector is fed by one or more feed horns which operate at both the uplink and downlink frequency bands, thereby reducing the need for separate horns optimized for both frequency bands. More particularly, in one embodiment of the invention, at least one of the feed horns for a reflector supports the $LSE_{1,0}$ mode at the lower transmit frequency and both the $LSE_{1,0}$ and $LSE_{3,0}$ modes at the higher receive frequency. In the particular embodiment, the lower transmit frequency is the 3.95 GHz frequency band and the higher receive frequency is the 6.2 GHz frequency band.

Figure 2A:
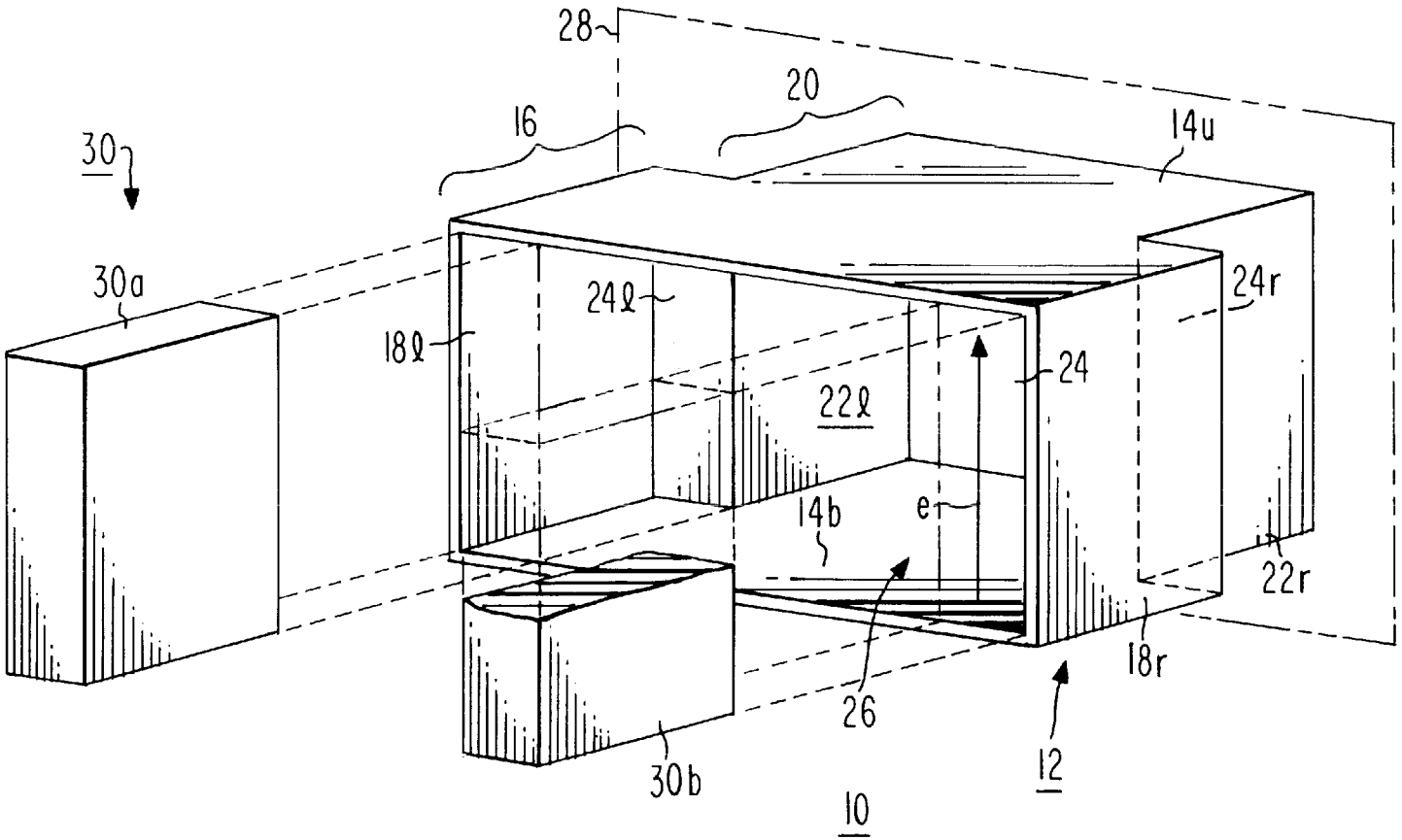
FIGS. 2*a* and 2*b* are simplified, exploded perspective or isometric views of a horn antenna according to an aspect of the invention, showing the dielectric slabs associated with the antenna of FIGS. 1*a* and 1*b*.
Figure 2B:
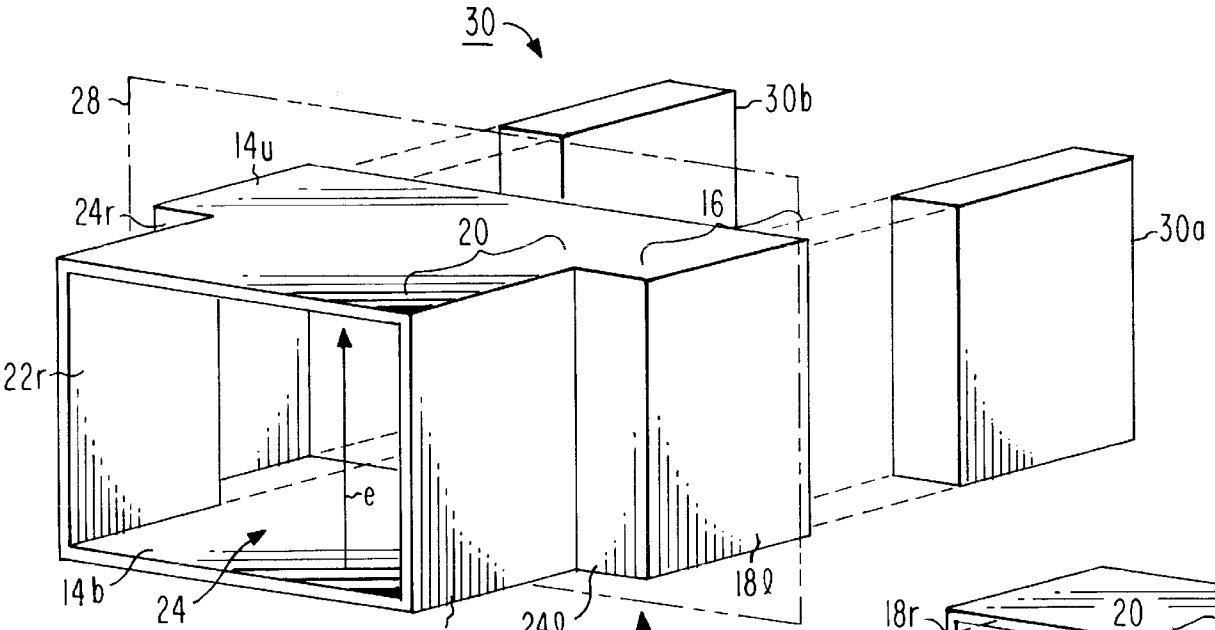
Figure 4:
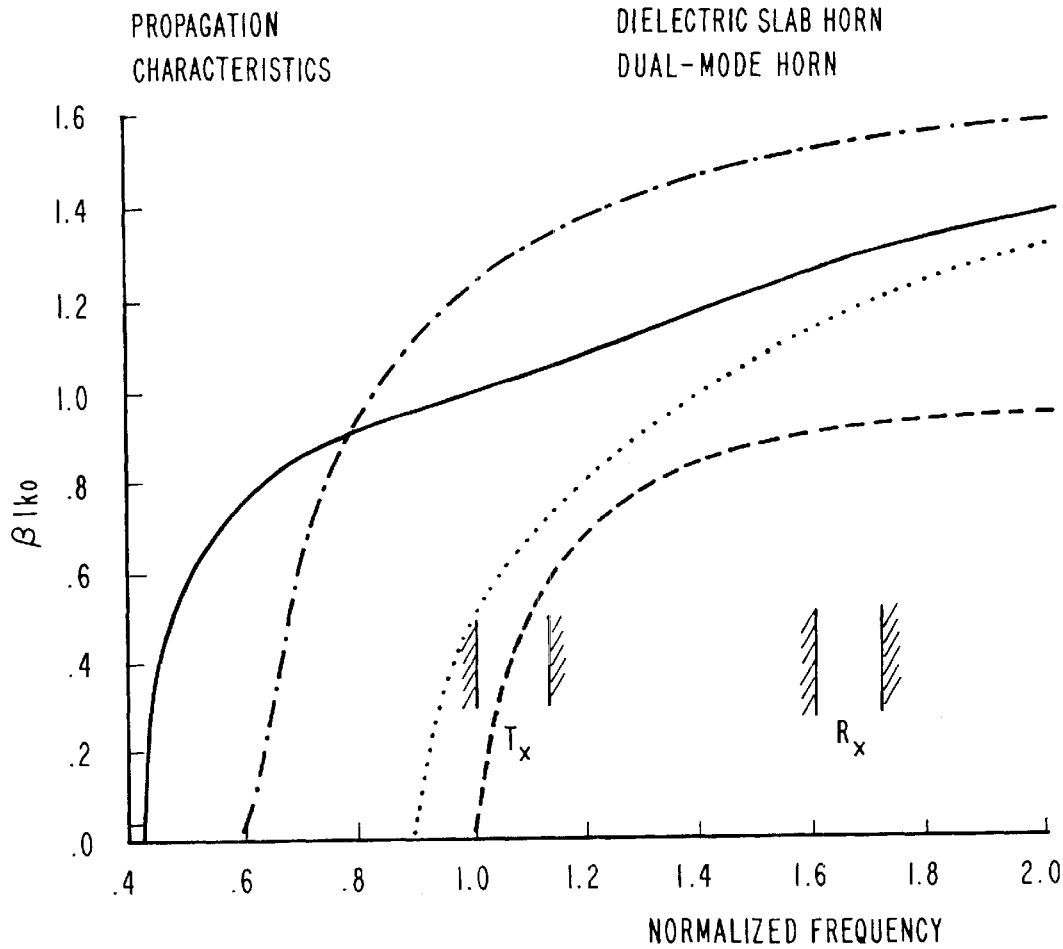
FIG. 4 plots calculated normalized propagation constants for various dominant modes in the horn.

In FIGS. 2*a* and 2*b*, a set 30 of dielectric slabs including a pair of dielectric slabs or plates 30*a*, 30*b* is seen exploded away from metallic horn 12. As illustrated by phantom lines, the dielectric slab 30*a* lies against the interior of H-plane wall 18*l*, and extends from upper plate 14*u* to lower or bottom plate 14*b*. The dimensions of dielectric slab 30*a* are selected so that it extends roughly from transverse wall 24*l* to the plane of radiating aperture 26. Similarly, dielectric slab 30*b* lies against the interior of vertical or H-plane wall 18*r*, and extends from upper plate 14*u* to lower plate 14*b*. These plates provide dielectric loading which tends to improve the aperture distribution of the antenna 10 at the lower frequency at which only the $LSE_{1,0}$ mode exists, and to provide additional phase shift between the $LSE_{1,0}$ and the $LSE_{3,0}$ mode at the higher frequency, to provide correct phasing of these two modes at the radiating aperture. The dispersion or differential phase shift between the $LSE_{1,0}$ and the $LSE_{3,0}$ modes as a function of frequency must be controlled at the higher operating frequency, and the bandwidth of the high-frequency operation is dependent upon reducing the dispersion. The dispersion depends upon characteristics of the horn in the region between the mode launching step and the radiating aperture, but depends more strongly upon the mode transformer or step itself. Computed normalized propagation constants $\beta/k_0$ as a function of normalized frequency for various modes are plotted in FIG. 4 for a square waveguide with wall dimensions of 3.67", with a pair of dielectric slabs of dielectric constant $\in_r$, each 0.58" thick, lying on or abutting the E-plane walls.

Figure 2C:
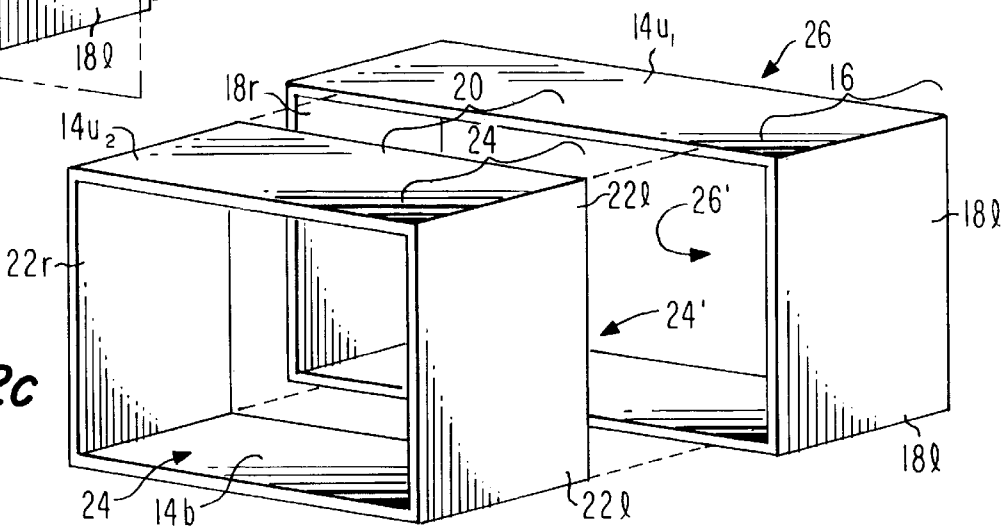
FIG. 2*c* is an exploded representation of the electrically conductive horn of FIGS. 2*a* and 2*b* conceptually exploded to illustrate the apertures of the various portions.

FIG. 2*c* represents the metallic horn structure 12 of FIGS. 2*a* and 2*b*, with portions 16 and 20 conceptually split from each other at the step, corresponding to plane 28. When the portions 16 and 20 are split from each other, a pair of new apertures is generated. More particularly, portion 16, which is already associated with the radiating aperture 26, gains a further aperture 26'. Similarly, portion 20, which is already associated with the feed port 24, gains a new aperture 24' lying adjacent to aperture 26'. Thus, the combined structure of FIGS. 2*a* and 2*b* may be considered to include conjoined apertures 24', 26' juxtaposed at plane 28. These apertures have differing dimensions in the H plane, thereby contributing to the presence of a mode-generating step.

In general, the H-plane dimension of the radiating-aperture side of the step must be less than about 1.5 λ to avoid generation of higher-order modes at the lowest operating frequency, and must be effectively larger (taking the dielectric into account) than about 1.5 λ at higher (receive band) frequencies than the lower frequency (transmit) band, corresponding to about 3.5" at C-band. The E-plane flare of the horn must be minimized in order to reduce the generation of $LSE_{12}$ and $LSM_{12}$ modes, which can be supported in the horn. Generation of such modes would adversely affect the radiation pattern of the horn in the E plane.

Figure 3B:
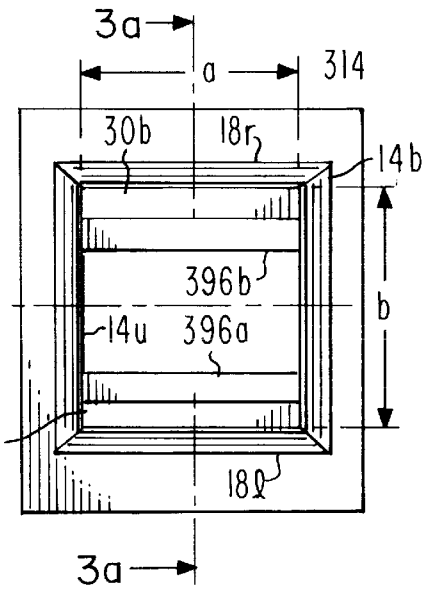
FIG. 3*b* is an end view thereof.
Figure 3A:
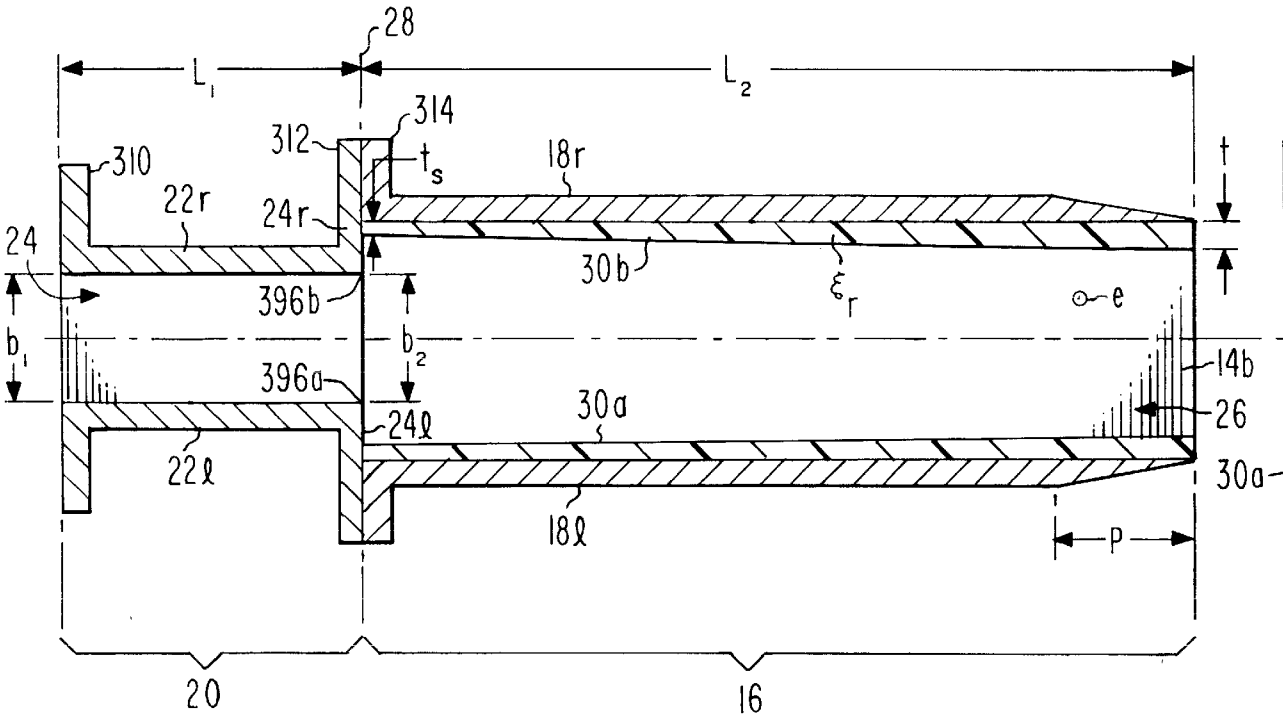
FIG. 3*a* is a cross-section, taken in the H-plane, of an assembled horn antenna equivalent to that of FIGS. 2*a* and 2*b*.
Figure 3D:
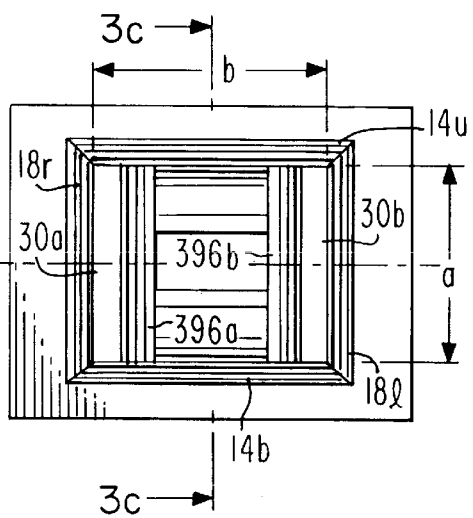
FIG. 3*d* is an end view thereof.
Figure 3C:
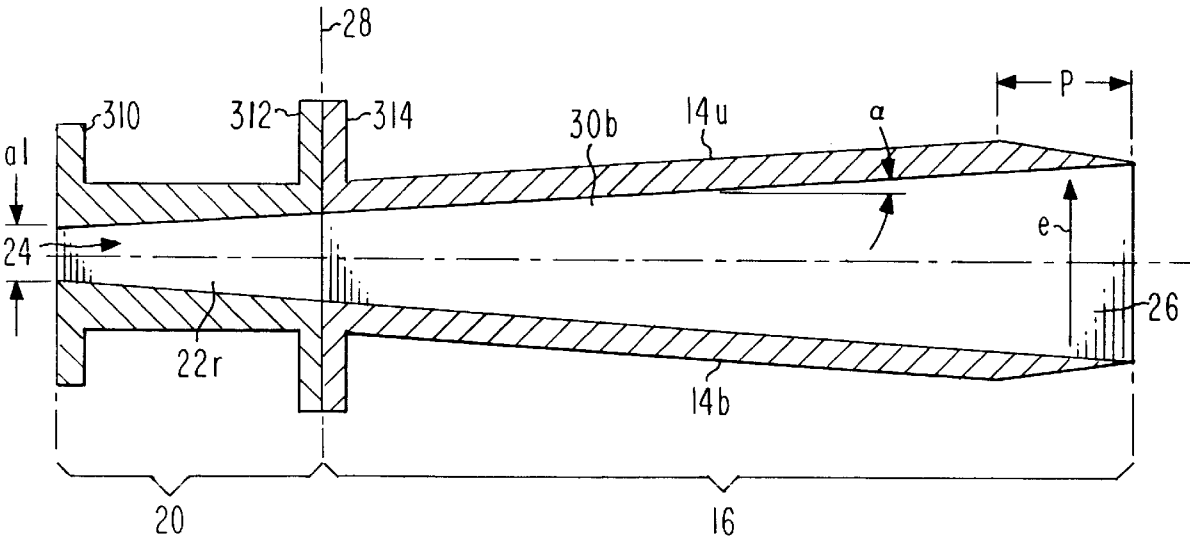
FIG. 3*c* is a cross-section, taken in the E-plane, of the assembled horn of FIG. 3*a*.

FIGS. 3*a* and 3*c* are cross-sections of an antenna equivalent to that of FIGS. 2*a* and 2*b*, taken in the H- and E-planes, respectively, and FIGS. 3*b* and 3*d* are end views thereof. Elements of FIGS. 2*a* and 2*b* found in FIGS. 3*a* through 3*d* are designated by the same reference numerals. The sole difference between the arrangement as illustrated in FIGS. 3*a* through 3*d* and that of FIGS. 2*a* and 2*b* lies in the presence of flanges to facilitate connections and assembly of the structure. More particularly, a waveguide joining flange illustrated as 310 is affixed to the feed side of the structure, to provide a means for fastening a feed waveguide to feed aperture 24, and in addition the phasing section 16 is fabricated separately from the feed-end section 20, and the two halves are joined by a pair of flanges 312, 314. These structural differences have no effect on the theory or performance of the horn. In the end views of FIGS. 3*b* and 3*d*, lines 396*a* and 396*b* correspond to the correspondingly designated corners of waveguide section or portion 20. In FIGS. 3*a*, 3*b*, 3*c*, and 3*d*, a preferred embodiment of the invention for use in the C-band ranges of 3.7 to 4.2 GHz and 5.925 to 6.425 GHz is tapered only in the E plane in the phasing section, and has the following dimensions.

| FEED-END PORTION 20 | | |
|---|---|---|
| L1 | | ≈4.0 inch |
| a1 | | 0.87 inch |
| b1 | | 1.87 inch |
| b2 | | 1.96 inch |
| α | | ≈5.73° |

-continued

| PHASING PORTION 16 | | |
|---|---|---|
| L2 | | ≈6.6 inch |
| a | | 3.0 inch |
| b | $1.15\lambda_o$ | 3.67 inch |
| t | $0.18\lambda_o$ | 0.58 inch |
| ts | $0.10\lambda_o$ | 0.32 inch |
| p | | ≈1 inch |
| $\epsilon_r$ | | 3.0 |

The horn as described has E and H-plane radiating aperture dimensions of 0.45 and 1.0 λ, respectively, at 3.7 Ghz. The relatively small E-plane dimension is selected to increase the cut-off frequencies of any $LSE_{1,2}$ and $LSM_{1,2}$ modes which might be generated. The return loss was about 9 dB without tuning, and a bit better with the use of tuning screws. The amplitude difference between the two modes at the higher frequency was higher than expected, with the difference over the expected contribution of the mode launcher and phasing section being attributed to the effects of a standing wave arising from the small E-plane dimension of the aperture. The standing wave is believed to modify the ratio between the $LSE_{1,0}$ and $LSE_{3,0}$ modes.

A horn for operation at Ku band transmit and receive frequencies is somewhat different than the C-band version set forth above, because the frequency ratios of the transmit and receive frequencies at Ku are different from those at C. The dimensions of an equivalent horn for use at Ku band are about

| FEED-END PORTION 20 | | |
|---|---|---|
| L1 | | ≈1.3 inch |
| a1 | | 0.3 inch |
| b1 | | 0.6 inch |
| b2 | | 0.7 inch |
| α | | ≈5.7° |
| PHASING PORTION 16 | | |
| L2 | | ≈2.1 inch |
| a | | 1.0 inch |
| b | $1.15\lambda_o$ | 1.2 inch |
| t | $0.18\lambda_o$ | 0.2 inch |
| ts | $0.10\lambda_o$ | 0.1 inch |
| p | | ≈0.3 inch |
| $\epsilon_r$ | | 3.0 |

Figure 5:
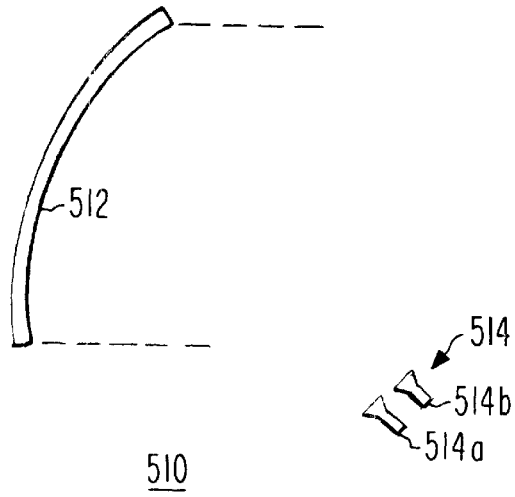
FIG. 5 is a conceptual representation of a reflector-type antenna including plural feed horns, at least one of which is a horn similar to FIGS. 2*a* and 2*b;*

FIG. 5 illustrates a reflector-type antenna 510 including a reflector 512 and a feed structure with a set 514 of horns, including horns 514*a* and 514*b*. According to an aspect of the invention, at least one horn of the set is a stepped, dielectric-loaded horn operable at disparate frequencies. In the context of a communications spacecraft antenna, the lower of the two disparate frequencies may be a transmit frequency, and the higher of the two may be a receive frequency. It is expected that use of such stepped, dielectric loaded horns as feeds for reflector-type antennas can reduce the number of feed horns required for operation, there by directly reducing weight, and also reducing weight by reducing the number of ports of a beamformer which are required to be plumbed.

Figure 6B:
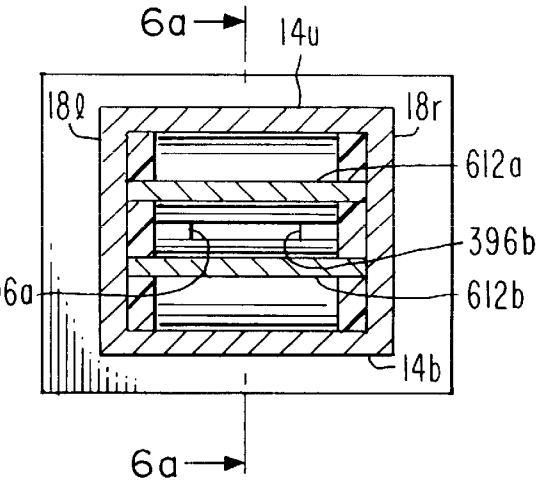
FIGS. 6*a* and 6*b* are cross-sectional views of a horn antenna according to another aspect of the invention, which includes mode suppression and/or aperture distribution control vanes.
Figure 6A:
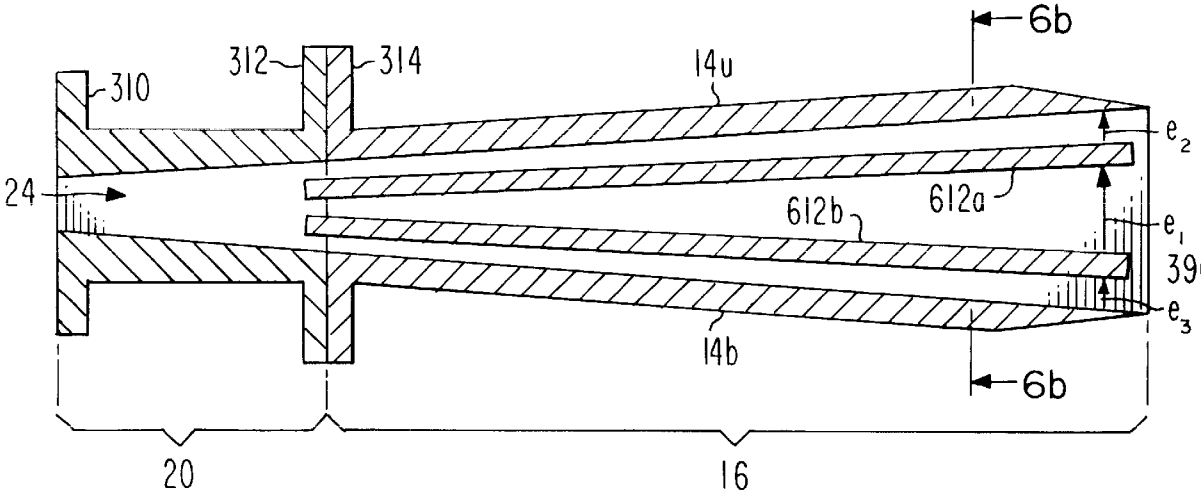

FIGS. 6*a* and 6*b* are cross-sectional views of a horn antenna 610 according to another aspect of the invention, in which one or more mode suppressing vanes are located within the horn. In FIGS. 6*a* and 6*b*, a horn similar to that of FIGS. 3*a*, 3*b*, 3*c*, and 3*d* is designated by the same reference numerals. Within horn 610 of FIGS. 6*a* and 6*b*, a pair of additional electrically conductive walls 612*a* and 612*b* lie generally parallel with the upper and lower walls 14*u* and 14*b*, respectively. As illustrated, the vanes extend through all of portion 16 of the horn, and also through a part of portion 20 of the horn. The vanes or walls 612*a* and 612*b* are supported by walls 18*l* and 18*r*, and may make electrical contact with walls 18*l* and 18*r*. Vanes or walls 612*a*, 612*b* may be viewed as being E-plane walls. Vanes or walls 612*a* and 612*b* can perform two different, but related, functions. The first function is to prevent or ameliorate the generation of higher-order modes in those cases in which the E-plane taper is great enough so that the E-plane dimension becomes large. The second function is to aid in tapering the E-plane radiating aperture distribution, as known in the art, to reduce reflector spillover from horn sidelobes. While the walls or vanes 610*a*, 610*b* have been shown as extending through at least parts of portions 16 and 20 of the horn of FIGS. 6*a* and 6*b*, they may extend through only a part of one portion, or through the entirety of both portions. While two such vanes have been illustrated, the mode suppression and aperture distribution control can be achieved with a single vane, or with a number of vanes greater than two. It should be noted that the use of a single vane for aperture distribution control necessarily results in an asymmetric radiation pattern.

The horn antenna according to the invention allows operation with relatively high gain at a lower frequency within a band due to the E-plane dielectric loading, and achieves relatively high gain at a higher frequency in the band due to the mode generation by the H-plane step together with the phasing contribution of the dielectric. The relatively high gain at disparate frequencies, coupled with relatively small aperture dimensions, allows such horns to be used in feed-horn clusters of reflector-type antennas with the horns closely spaced to provide for generating separate beams which are angularly closely spaced. Such horns also reduce or eliminate the need for separate horns for the transmit and receive frequencies, and thus reduce overall weight and cluster dimensions.

Other embodiments of the invention will be apparent to those skilled in the art. For example, operation at other frequencies may be achieved by scaling the dimensions of the horn.

Thus, a horn antenna (10) according to an aspect of the invention includes an electrically conductive tapered first portion (18) defining a rectangular waveguide feed aperture (24) and a second rectangular aperture (24') which is larger than the feed aperture (24) dimension, at least in the H plane. The horn (10) includes an electrically conductive tapered rectangular second portion (16) defining a first aperture (261) and a radiating aperture (26). The first aperture (26') of the second portion (16) is larger than the second aperture (24') of the first portion (18) in the H plane, and the first aperture (26') of the second portion (16) is identical in dimension to the second aperture (24') of the first portion (18) in the E plane, thereby defining an H-plane step in dimension, but not an E-plane step. The horn (10) further includes electrically conductive means (24*l*, 24*r*) coupling the walls (18*r*, 22*r*; 18*l*, 22*l*) of the first (20) and second (16) portions at the H-plane step (plane 28). The electrically conductive means (24*l*, 24*r*) in a preferred embodiment is no more than a pair of vertical walls. The horn (10) further includes first (30*a*) and second (30*b*) dielectric slabs, each of which dielectric slabs lies against or is juxtaposed to one of the E-plane walls of the second section, and extend from near the step (plane 28) to near the radiating aperture (26).

In a particular embodiment of the horn (10), at least one of the first (20) and second (16) portions is tapered ($\alpha$) in the E plane, and preferably both portions (16, 20) are tapered in the E plane. The second portion (16) of the horn (10) may be square in cross-section. In yet another embodiment, each of the dielectric slabs (30*a*, 30*b*) is tapered in thickness, with the thickest portion lying nearest the radiating aperture (26).

In another avatar of the invention, a dielectric loaded stepped horn such as that described above is used as at least a portion of a feed of a reflector-type antenna (510).

A further manifestation of the invention includes a dielectrically loaded horn stepped in the H-plane at a transverse plane,

What is claimed is:

1. A horn antenna, comprising:

an electrically conductive rectangular first waveguide portion defining a rectangular waveguide feed aperture and a second rectangular aperture which is larger than said feed aperture, at least in the H plane;

an electrically conductive rectangular second waveguide portion defining a radiating aperture and a second aperture, said second aperture of said first waveguide portion being juxtaposed with said second aperture of said second waveguide portion with corresponding polarizations, said second aperture of said second waveguide portion being larger than said second aperture of said first waveguide portion in the H plane, and said second aperture of said second portion being identical in dimension to said second aperture of said first portion in the E plane, thereby defining an H-plane step in dimension, but not an E-plane step;

electrically conductive means coupling the walls of said first and second waveguide portions at said H-plane step to thereby define complete H-plane walls extending from said feed aperture to said radiating aperture; and first and second dielectric slabs, each of said dielectric slabs lying against the H-plane walls of said second waveguide portion and extending from near said step to near said radiating aperture.

2. A horn antenna according to claim 1, wherein at least one of said first and second waveguide portions is tapered in the E plane.

3. A horn antenna according to claim 2, wherein both said first and second waveguide portions are tapered in the E plane.

4. A horn antenna according to claim 3, wherein the tapers of said first and second waveguide portions in said E plane are equal.

5. A horn antenna according to claim 1, wherein a cross-section of said second waveguide portion defines a square.

6. A horn antenna according to claim 1, wherein each of said dielectric slabs is tapered in thickness, with the thickest portion lying nearest said radiating aperture.

7. A horn antenna for C-band, comprising:

a first waveguide portion including a rectangular feed port and a rectangular second port, said feed port having an E-plane dimension of about 0.87 inch and an H-plane dimension of about 1.87 inch, and said second port having a particular E-plane dimension and an H-plane dimension of about 1.96 inch;

a second waveguide portion about 6.6 inches long, and including a radiating aperture and a second port, said radiating aperture having an E-plane dimension of about 3 inches and an H-plane dimension of about 3.6 inches, and said second port of said second waveguide portion having an H-plane dimension of about 3.6 inches and an E-plane dimension equal to said particular E-plane dimension of said second port of said first waveguide portion, said second port of said first and second waveguide portions being juxtaposed at a common plane with corresponding polarizations, to thereby define a horn which is stepped in the H plane and which has a taper of about 5.7° in the E plane; and first and second dielectric slabs, each of said slabs having a height of about 3 inches, a length of about 6.6 inches, a thickness, and a dielectric constant of about 3, each of said slabs lying adjacent to an E-plane wall of said second waveguide portion at a location lying between said common plane and said radiating aperture.

8. A horn antenna for Ku-band, comprising:

a first waveguide portion including a rectangular feed port and a rectangular second port, said feed port having an E-plane dimension of about 0.29 inch and an H-plane dimension of about 0.63 inch, and said second port having a particular E-plane dimension and an H-plane dimension of about 0.66 inch;

a second waveguide portion about 2.1 inches long, and including a radiating aperture and a second port, said radiating aperture having an E-plane dimension of about 1 inch and an H-plane dimension of about 1.2 inches, and said second port of said second waveguide portion having an H-plane dimension of about 1.2 inches and an E-plane dimension equal to said particular E-plane dimension of said second port of said first waveguide portion, said second port of said first and second waveguide portions being juxtaposed at a common plane with corresponding polarizations, to thereby define a horn which is stepped in the H plane and which has a taper of about 5.7° in the E plane; and first and second dielectric slabs, each of said slabs having a height of about 1 inch, a length of about 2.1 inches, and a thickness, and a dielectric constant of about 3, each of said slabs lying adjacent to an E-plane wall of said second waveguide portion at a location lying between said common plane and said radiating aperture.

9. A reflector-type antenna, comprising:

a reflector defining at least a focal region;

a set of horns located at said focal region, at least one of said horns including (a) an electrically conductive rectangular first waveguide portion defining a rectangular waveguide feed aperture and a second rectangular aperture which is larger than said feed aperture at least in the H plane;

(b) an electrically conductive second rectangular waveguide portion defining a radiating aperture and a second aperture, said second aperture of said second waveguide portion being larger than said second aperture of said first waveguide portion in the H plane, and said second aperture of said second waveguide portion being identical in dimension to said second aperture of said first waveguide portion in the E plane, thereby defining an H-plane step in dimension, but not an E-plane step;

(c) electrically conductive means coupling the walls of said first and second waveguide portions at said H-plane step to thereby define continuous H-plane walls extending from said feed aperture to said radiating aperture; and (d) first and second dielectric slabs, each of said dielectric slabs lying against the H-plane walls of said second waveguide portion and extending from near said step to near said radiating aperture.

10. A horn antenna, comprising:

an electrically conductive first waveguide portion including E-plane and H-plane walls defining a rectangular waveguide feed aperture and a rectangular second aperture which is larger than said feed aperture, at least in the H plane;

an electrically conductive rectangular second waveguide portion including E-plane and H-plane walls defining a radiating aperture and a second aperture, said second aperture of said first waveguide portion being juxtaposed with said second aperture of said second waveguide portion, said second aperture of said second waveguide portion being larger than said second aperture of said first waveguide portion in the H plane, and said second aperture of said second waveguide portion being identical in dimension to said second aperture of said first waveguide portion in the E plane, thereby defining an H-plane step in dimension, but not an E-plane step, at least one of said first and second waveguide portions of said horn antenna being tapered in the E plane;

electrically conductive means coupling the walls of said first and second waveguide portions at said H-plane step to thereby form continuous H-plane walls extending from said feed aperture to said radiating aperture;

at least first and second dielectric slabs, each of said dielectric slabs lying against at least a portion of the H-plane walls of said second waveguide portion and extending from near said step to near said radiating aperture; and at least one electrically conductive further wall, said further wall lying between said E-plane walls of said second waveguide portion and generally parallel therewith, said further wall being supported by said H-plane walls.

11. A horn antenna according to claim 10, wherein said at least one electrically conductive further wall makes electrical and physical contact with said H-plane walls.

12. A horn antenna according to claim 10, wherein said at least one electrically conductive further wall comprises two electrically conductive further walls, spaced from each other and equally spaced from said E-plane walls.

13. A horn antenna according to claim 10, wherein both said first and second portions of said horn antenna are tapered in the E plane.

14. A horn antenna according to claim 13, wherein said taper of said first and second portions of said horn antenna are equal.

* * * * *